US005148646A

United States Patent [19]

Lutostanski

[11] Patent Number: 5,148,646

[45] Date of Patent: Sep. 22, 1992

[54] CONVERTIBLE ENCLOSURE FOR HOT TUBS AND THE LIKE

[76] Inventor: Leonard A. Lutostanski, 13709 Towering Oaks, Shelby Township, Oceana County, Mich. 48315

[21] Appl. No.: 742,326

[22] Filed: Aug. 8, 1991

[51] Int. Cl.[5] ..... E04B 1/343

[52] U.S. Cl. ..... 52/66; 52/63; 52/64; 52/68; 135/102; 4/498

[58] Field of Search ..... 135/103, 115, 102, 107, 135/109; 52/66, 68, 63, 64; 160/174; 4/498, 503; 5/113, 414

[56] References Cited

U.S. PATENT DOCUMENTS 701,349 6/1902 Jung .
1,014,848 1/1912 Reinert .
1,061,547 5/1913 Kennedy et al. .
2,519,638 8/1950 DiMarzo .
3,140,563 7/1964 Allen .

*Primary Examiner*—David A. Scherbel
*Assistant Examiner*—Matthew E. Leno
*Attorney, Agent, or Firm*—Krass & Young

[57] ABSTRACT

A convertible enclosure particularly adapted to cover an outside hot tub installation. The enclosure includes a tubular frame with sliding cross-pieces. A cover is attached to the cross-pieces such that the cover may be extended to encompass one side and the top of the space desired to be enclosed with the opposite side remaining open.

18 Claims, 3 Drawing Sheets

FIG-5A
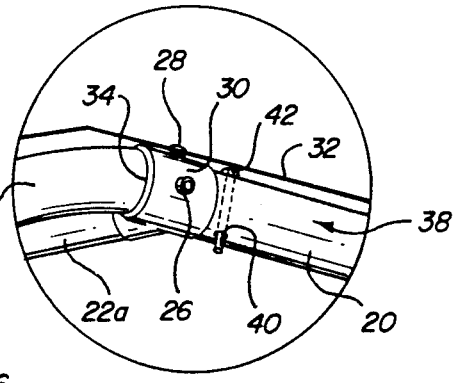
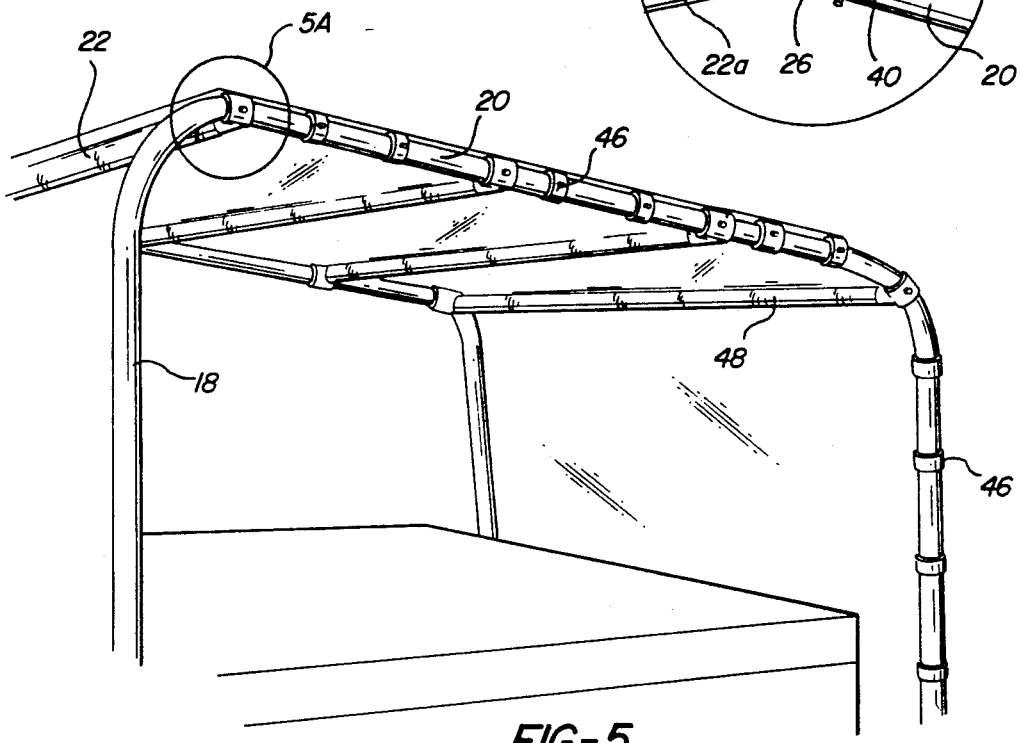
FIG-5
FIG-6
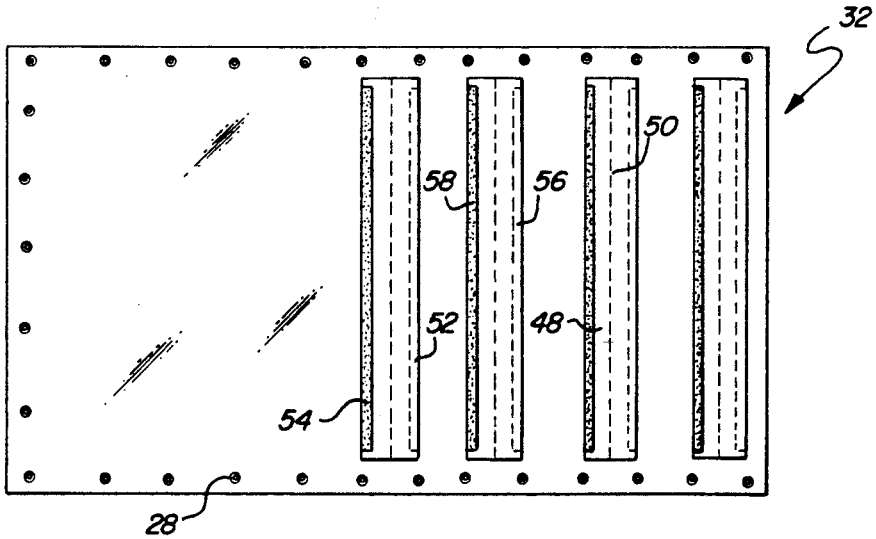

CONVERTIBLE ENCLOSURE FOR HOT TUBS AND THE LIKE

FIELD OF THE INVENTION

This invention relates to the field of convertible enclosures for partially enclosing a defined space, and, more particularly, to such an enclosure for enclosing an outdoor hot tub, spa, etc.

DESCRIPTION OF THE RELEVANT PRIOR ART

Hot tubs, spas and whirlpool baths have enjoyed tremendous and increasing popularity in recent years. Many hot tub installations are located outdoors because people enjoy using these devices al fresco. However, in many parts of the country, such outdoor usage of the hot tub or spa is severely curtailed during certain periods of the year due to inclement weather, such as severe cold, high winds, snow, etc.

The adverse impact of inclement weather on hot tub usage can be considerably alleviated by enclosing the fixture, either partially or completely. Of course, many people object to permanently enclosing an outdoor hot tub since many of the pleasures and benefits of using the device outdoors are lost. A convertible enclosure, which can enclose the hot tub when the weather is severe and can be removed when the weather is mild, goes far to solving the problem of how to extend the season of usage of the hot tub without losing the benefits of an out-of-doors installation.

The prior art discloses a number of attempts to achieve this dual objective. For example, U.S. Pat. No. 4,246,663 discloses a hot tub cover comprised of two hemispherical shells which extend over the hot tub to enclose its top surface and provide room for bathing. The two shells pivot with respect to one another such that the inner shell may be pivoted to a subadjacent position with respect to the outer shell, thus exposing half of the hot tub surface to the air. Another example of a hot tub enclosure is disclosed in U.S. Design Pat. No. 280,438 which appears to disclose an inflatable hot tub cover; presumably, it may be deflated as desired.

In addition to the above disclosed hot tub enclosures, the prior art also contains convertible enclosures for swimming pools or like fixtures, which could be adapted for use with a hot tub. For example, U.S. Pat. No. 3,662,410 discloses a convertible enclosure for a pool comprised of a plurality of support members which extend upwardly from a foundation and then arch out over the pool surface and are fastened at their opposite end to a steel gutter which is, in turn, secured to the eave of a house. Each support member, except the two at the ends, includes a pair of tracks on either side so that a series of flexible panels can be slidably supported between each pair of adjacent support members. The flexible panels can be raised or lowered along the tracks as desired to enclose, or uncover, the pool. A variety of other convertible enclosures, all of which include parallel, spaced support members which arch over the width of the pool from one side thereof to the other, are disclosed in U.S. Pat. Nos.: 3,766,691; 3,469,587; 3,424,179; and 3,415,260.

All of the above-referenced enclosures suffer from one or more disadvantages which limits their usefulness, such as unsightliness, mechanical complexity, difficulty of use, high cost or unreliability. Hence, there still exists a need for a low cost, simply constructed, attractive, easy-to-use, convertible enclosure for enclosing hot tubs, or for similar outdoor uses.

SUMMARY OF THE INVENTION

The convertible hot tub enclosure disclosed and claimed herein has been designed to overcome the disadvantages of the prior art noted above. In its broadest aspect, the convertible enclosure includes three main components: a frame; a flexible cover; and retaining means. The frame includes a pair of opposed, parallel end members arranged to define a rectangular, parallelepipoid space therebetween. In turn, each of the pair of opposed end members includes first and second tubular uprights and an interconnecting tubular top member. The interconnection between the top member and the first upright defines a curve.

A plurality of sliding cross-pieces connect the pair of opposed end members and are configured to slide along both of the pair of first uprights and along the top members from a first position, wherein the plurality of cross-pieces are disposed adjacent each other on the first uprights, to a second position wherein the cross-pieces are disposed along the top members at spaced intervals therealong. Each of the plurality of sliding cross-pieces carries a first attachment means proximate each of its ends.

The flexible cover is rectangular in configuration and is configured to cover the parallelipoid space defined by the pair of opposed, parallel end members along the top and at least one side of the space. The cover includes a plurality of second attachment means disposed along both sides of the cover and spaced along the top members at the same intervals as the first attachment means. The second attachment means are engagable with the first attachment means so that the cover can be fastened to the cross-pieces. When the cover is so attached to the cross-pieces, the defined space will be uncovered when the cross-pieces are in the first position and covered along the top and one side thereof when the cross-pieces are in the second position.

The retaining means retains the cross-pieces in the second position. By retaining the cross-pieces in the second position, the cover which is attached to the cross-pieces is also retained so that it covers the space. By removing the retaining means, the cross-pieces may be slidably moved from the second position back to the first position, thereby causing the cover to retract from the top and down the one side of the space so that the space remains uncovered.

The frame may further comprise a fixed cross-piece which interconnects the pair of first uprights at a location intermediate the top and bottom thereof. The fixed cross-piece carries a number of first attachment means spaced at intervals therealong. Similarly, more second attachment means are disposed on the cover along one end thereof at the same spaced intervals so that one end of the cover may be attached to the fixed cross-piece. This enables the cover more securely to be attached to the frame.

The enclosure of the present invention may further comprise a pair of end panels which are attached to the end members to enclose the ends of the defined space. Thus, when the cross-pieces are in the second position, this embodiment of the enclosure serves to cover all but one side of the space, thus affording the users of the hot tub or whatever is disposed in the space, a high degree of protection from the elements, while affording them easy access through the side of the space which remains open.

In a further embodiment of the enclosure of the present invention, the retaining means comprises an aperture formed through each of the top members at a location thereon proximate its interconnection with the second upright, and a lock pin engagable with each of these apertures. The apertures are located on the top members such that, when the cross-pieces are in the second position and the cover is attached to the cross-pieces, the cross-piece closest to the pair of second uprights is prevented from sliding motion along the top members. Thus, the cross-pieces are prevented from sliding back along the top members and down the first members to their first position, which would result in inadvertent uncovering of the space.

Preferably, the ends of each sliding cross-piece are configured to define a bore dimensioned to encompass the tubular uprights and cross members for sliding motion therealong. Typically, the sliding cross-pieces, the tubular uprights, and the top members are comprised of PVC tubing. It has been found that, if the inside diameter of the bore is selected to accommodate the outside diameter of the tubular uprights and top members, the cross-pieces will easily slide therealong.

Pairs of opposed bottom members interconnecting each pair of first and second uprights may be provided to complete the frame structure and render it relatively rigid.

Preferably, a plurality of parallel pockets are formed in the cover to extend thereacross from one side to the other and are spaced at the spaced intervals therealong as the cross-pieces are spaced along the top members. Each pocket is configured to receive one of the plurality of cross-pieces therein. Preferably, each of the plurality of pockets is formed of a long, narrow, rectangular piece of fabric attached to the cover along a longitudinal center line of the piece to define two flaps extending outward from the cover. The edges of the two flaps are provided with mating strips of hook-and-loop fastening material. A cross-piece may be enclosed in such a pocket by centering it along the longitudinal center line of the pocket and folding the flaps over the cross-piece so that the edges align to engage the hook-and-loop fastening material.

In order to further secure the cover to the frame, a plurality of sliding rings may be provided which are slidingly disposed along the top members and the first uprights. Each such ring carries a first attachment means for engagement with a corresponding second attachment means disposed on the edge of said cover.

Preferably, the first and second attachment means comprise the mating parts of snap fasteners. Hence, the cover may quickly and easily be removed from the frame by disengaging the mating strips of hook-and-loop fastener to release the cross pieces from the pockets formed on the cover, and by unsnapping the edges of the cover from the cross-pieces and sliding rings. However, it is not necessary to remove the cover from the frame in order to uncover the space since the cross pieces may be moved from the second, enclosed position, to the first, open position without removing the cover from the frame. Hence, if the cover is made of a flexible material, as the cross-pieces slide down the first uprights to their first position, it will naturally fold into accordion pleats, thus assuming a compact configuration which may be enclosed in a sock or jacket, if desired.

BRIEF DESCRIPTION OF THE DRAWINGS

The following detailed description may best be understood with reference to the following drawings, in which:

FIG. 5 is an inside, top perspective view of the cover of the present invention showing the arrangement of cross pieces, rings, and pockets thereof;

FIG. 5A is a detail view of FIG. 5 showing details of the retaining means; and FIG. 6 is a flat, plan view of the inside of the cover.

DETAILED DESCRIPTION OF THE PREFERRED EMBODIMENTS

Figure 1:
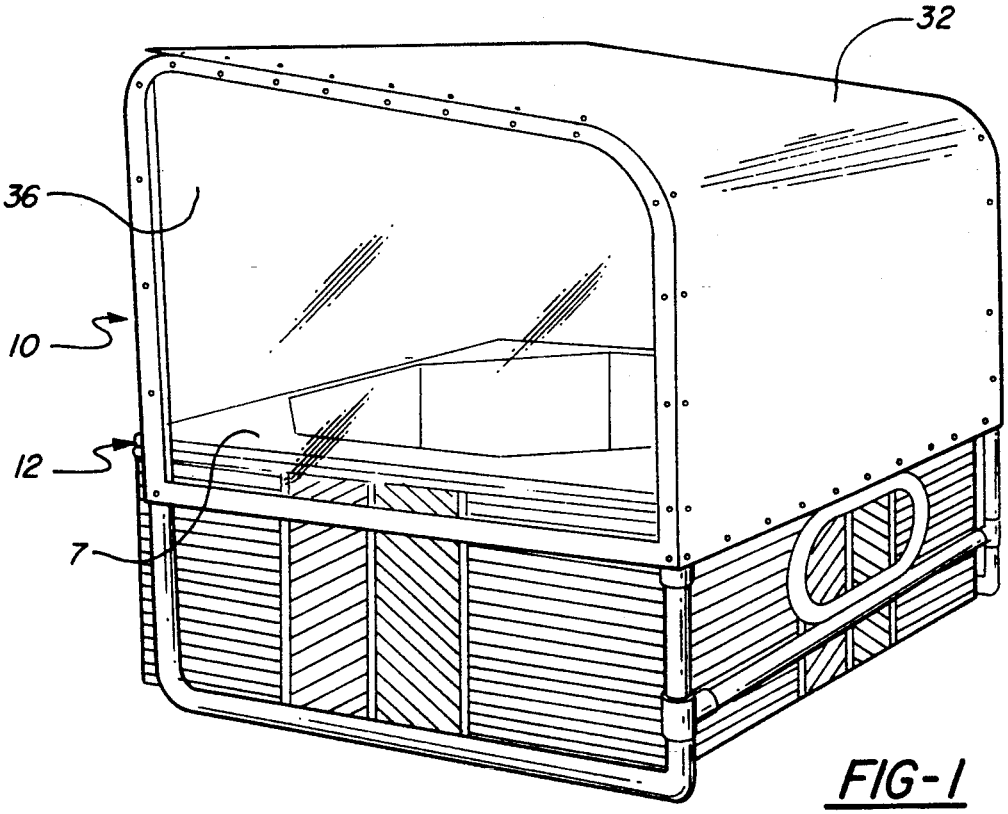
FIG. 1 is a perspective view of the convertible enclosure of the present invention in place over a hot tub installation.

Throughout the following detailed description, like reference numerals are used to refer to the same element of the present invention shown in multiple figures thereof. Referring now to the drawings, and in particular to FIG. 1, there is shown a convertible enclosure 10 of the present invention suitable for enclosing a hot tub 7. The two primary components of the enclosure 10 are frame 12 and cover 32 which, as can be seen in FIG. 1, covers one side and the top of the space occupied by the hot tub. Optionally, transparent end pieces 36 may be attached to the frame 12 so as to enclose the ends of the space.

Figure 3:
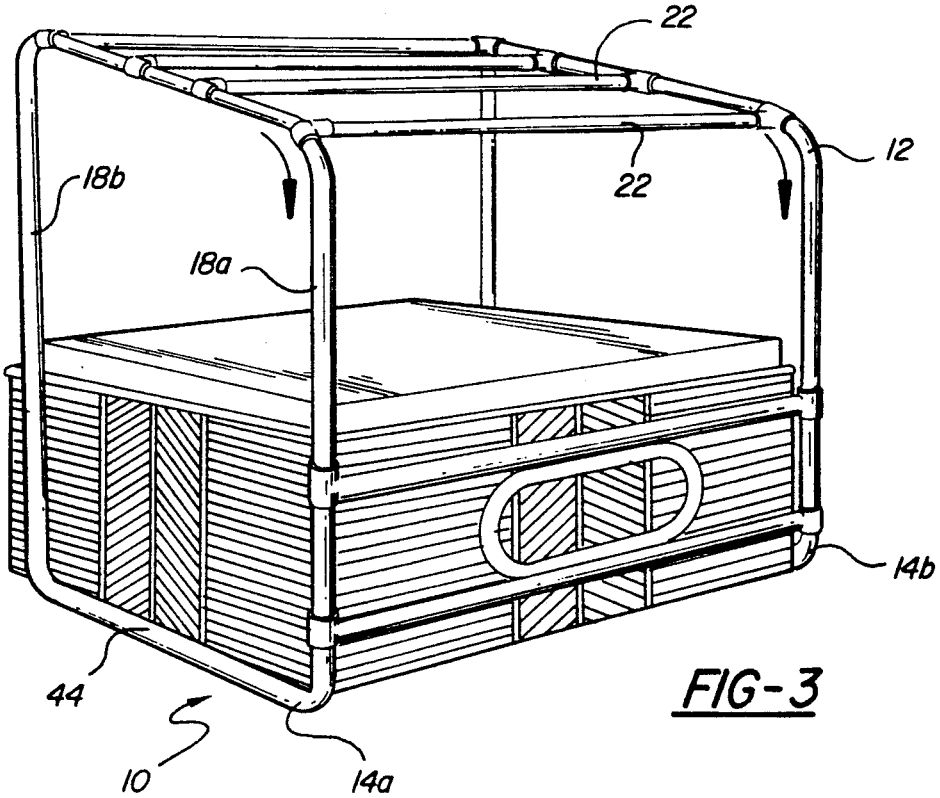
FIG. 3 is similar to FIG. 2 except that it shows the cross-pieces in their second position.
Figure 4:
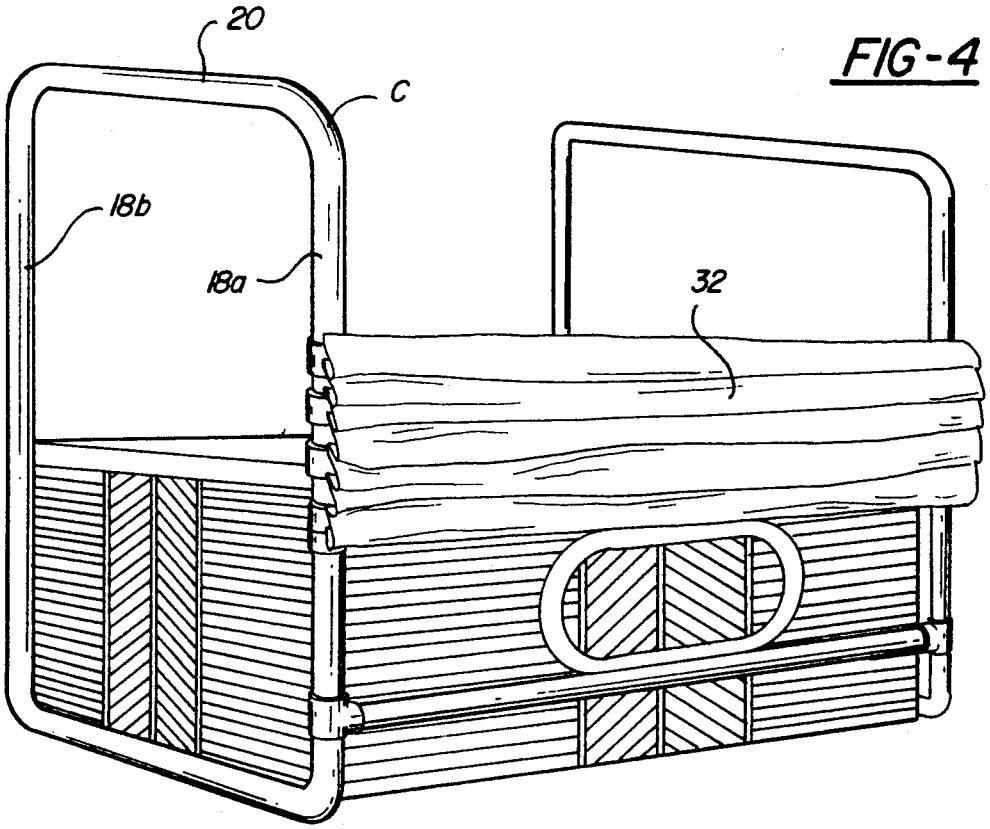
FIG. 4 is similar to FIG. 1 except that it shows the cross-pieces in the first position.

As best can be discerned from FIGS. 3 and 4, the frame 12 is comprised of a pair of opposed, parallel end members **14*a*,14*b* which are arranged to define a roughly rectangular parallelepipoid space therebetween suitable to contain the hot tub and its occupants. Each end member 14*a*,14*b* is, in turn, comprised of first and second uprights 18*a*,18*b* and top members 20 which interconnect the first and second uprights 18*a*,18*b* at the tops thereof. At least the interconnections between both first upright 18*a* of the end member 14*a*,14*b* and each top member 20 define a curve C as is shown in FIG. 4**.

A plurality of sliding cross-pieces 22, best seen in FIG. 3, connect opposed end members **14*a*,14*b*. Each of the plurality of sliding cross-pieces 22 is configured to slide along both first uprights 18*a* and both top members 20 interconnected thereto. The plurality of cross-pieces 22 slide along the first uprights 18*a* and top members 20 from a first position, shown in FIG. 2, wherein the plurality of cross pieces 22 are disposed adjacent each other on the first uprights 18*a*, to a second position, shown in FIG. 3, wherein the plurality of cross-pieces 22 are disposed along the top members 20** at spaced intervals therealong.

A flexible, rectangular cover 32, shown in FIG. 6, is configured to cover the defined space along the top and one side thereof. The cover includes a plurality of second attachment means 28 disposed along the sides and one end thereof. Mating first attachment means 26 (shown in FIG. 5A) are disposed on the end 30 of each of the plurality of cross-pieces 22.

The cover 32 further comprises a plurality of parallel, spaced pockets 48 which are formed on the cover and extend thereacross from one side to the other at the previously defined spaced intervals. Each pocket 48 is configured to receive a cross-piece 22 therein. Preferably, each pocket 48 is formed of a rectangular piece of material seamed to the cover 32 along a longitudinal center line 50 so as to define first and second flaps 52,54 which are provided with mating strips 56,58 of hook-and-loop fastening material.

The manner of attachment of the cover 32 to frame 12 is best seen in FIGS. 5 and 5A. In the embodiment depicted therein, a plurality of sliding rings 46, each carrying a first attachment means 26 for engagement with one of the plurality of attachment means 28 disposed on cover 32, are slidingly disposed along the top members 20 and the first uprights 18*a*. The first attachment means 26 carried by the cross pieces 22 and the sliding rings 46 are engaged with corresponding second attachment means disposed on cover 32, thus securing the cover 32 to the frame 12.

When the cover is in the second position shown in FIG. 5, each cross piece 22 disposed along top members 20 will be aligned with a pocket 48. By enclosing the cross-piece 22 with first and second flaps 52,54 and engaging the first strip 56 of hook and loop fastener with the second strip 58 of hook and loop fastener, each cross-piece 22 is snugly enclosed in a pocket 48. In this manner, the cover 32 is firmly and securely, yet easily, fastened to the frame 12. It may also easily be detached therefrom by simply disengaging the first and second strips 56,58, thus releasing the cross-pieces 22 from the pockets 48, and by disengaging each second attachment means 28 from its corresponding first attachment means 26. In the embodiment depicted in the detail view 5A, the first and second attachment means 26,28 are the corresponding portions of a typical snap fastener. However, other fastening means may be used, such as grommets and wing nuts, ties, screws, etc.

Figure 2:
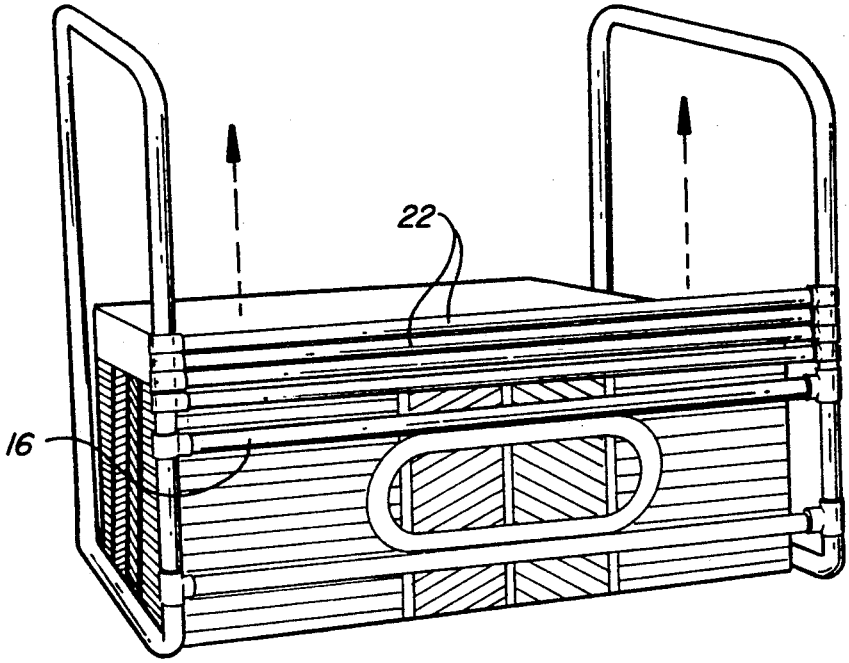
FIG. 2 illustrates the frame portion of the present invention with the cross-pieces thereof in the first position.

The enclosure 10 of the present invention may further comprise a fixed cross-piece 16 which interconnects each first upright 18*a* of the pair of end members 14*a*,14*b* at a location thereon intermediate of the top and bottom thereof, as can be seen in FIG. 2. The fixed cross-piece 16 may further be provided with first attachment means 26 at spaced intervals thereon to correspond with the second attachment means 28 disposed on the end of cover 32, as is shown in FIG. 6. Thus, the end of cover 32 may be fastened to frame 12 by engaging all of the second attachment means 28 disposed thereon with the first attachment means 26 disposed along fixed cross piece 16. To further lend rigidity to the frame 12, bottom pieces 44, shown in FIG. 3, may be provided for interconnecting each pair of first and second uprights 18*a*,18*b*.

Both ends 30 of each cross-piece 32 are, preferably, configured to define a bore 34, seen in FIG. 5A. The inside diameter of bore 34 is slightly larger than the outside diameter of the top members 20 and first uprights 18*a* upon which cross-pieces 22 slide. Since, preferably, the top members 20 and first uprights 18*a* are constructed of polyvinyl chloride tubing, the cross-pieces 22 will move easily from their first position to their second position, and back again. Moreover, the PVC material will not rust, and the sliding members easily slide on tubular pieces, rather than on the tracks disclosed in the prior art, which are prone to blockage and jamming due to accumulation of debris therein. Thus, the construction of the present invention lends itself particularly well to outside installation.

The details of the retaining means 38 are disclosed in FIG. 5A. In the preferred embodiment, a bore 40 is formed in each top member 20 at a location thereon proximate the cross-piece 22*a* closest to the interconnection of top members 20 with second uprights 18*b*. After the cross-pieces 22 have been moved into their second position, lock pins 42 may be inserted into the bores 40 to prevent cross-pieces 22*a* from moving back across top members 20 and down first uprights 18*a* to the first position. Attaching cover 32 to frame 12 will prevent cross-pieces 22*a* and the other cross-pieces 22 from movement in either direction.

After the cover 32 has been attached to the frame 12 in the manner described above, it is easy to raise and lower the cover from the configuration shown in FIGS. 1 and 5, wherein all sides but one of the space occupied by hot tub 7 are enclosed, to the configuration shown in FIG. 4, wherein only the sides remain covered. To lower the cover, one first removes the lock pins 42 from their respective bores 40 to release cross-piece 22*a*. The cover 32, which remains attached to cross-pieces 22 and sliding rings 46, may then be retracted by sliding the cross-pieces 22 back across top members 20 and first uprights 18*a* to the first position. It is a simple matter to make sure that the cover 32 folds into neat accordion pleats while this operation is being performed. When the cross-pieces are in their first position, the cover will assume the compact configuration shown in FIG. 4. It may then be covered with a sock or jacket (not shown) to present an even neater appearance. Raising the cover 32 is an equally simple operation. One simply slides the cross-pieces 22 up uprights 18*a* and across top members 20 until they are in their second position, thus stretching the cover 32 over one side and the top of frame 12. The lock pins 42 are then inserted into bores 40 to prevent movement of the cross-pieces 22.

Although illustrated as a hot tub enclosure, the enclosure of the present invention finds equal utility in many other situations. For example, it can serve as an easily erected sun shield at the beach, or it may be used as a wind screen. The cover may be constructed of a variety of materials, according to the use intended, including plastic laminate, nylon, rip stop nylon, canvas, oilcloth, coated fabrics, etc. In the preferred embodiment, the cover is made from a polyester or nylon scrim reinforced polyvinylchloride vinyl film, such as is manufactured by Snyder Manufacturing, Inc. of Dover, Ohio and sold under the trade names WeatherSpan TM, KlearSpan TM and Perma Bar TM. Such materials have proven to be tough, long-lasting, waterproof and lightweight.

While the invention claimed herein has been described with reference to particular embodiments and exemplifications thereof, variations thereof may occur to one skilled in the art by employing the teachings of the present invention. The scope of the present invention is not intended to be limited by the exemplifications and embodiments depicted herein, but, rather, solely by the claims appended hereto and any equivalents thereof.

I claim:

1. A convertible enclosure for covering a hot tub spa or the like comprising:

I. a frame including:

A) a pair of opposed, parallel end members arranged to define a rectangular parallelepipoid space therebetween and each including first and second tubular uprights and an interconnecting tubular top member, the interconnection between said top member and each of said first uprights defining a curve; and B) a plurality of sliding cross-pieces connecting said opposed end members and configured to slide along both of said first uprights and along said top members from a first position, wherein said plurality of cross-pieces are disposed adjacent each other on said first uprights, to a second position wherein said plurality of cross-pieces are disposed along said top members at spaced intervals therealong, each of said sliding cross-pieces carrying a first attachment means proximate each end thereof;

II. a flexible, rectangular cover having two opposed sides and two opposed ends and configured to cover said defined space along the top and at least one side thereof, said cover including a plurality of second attachment means disposed along both sides of said cover at said spaced intervals and engagable with said first attachment means such that, when said cover is attached to said cross-pieces by engaging said first attachment means with said second attachment means, said space is uncovered when said cross-pieces are in said first position and covered by said cover at said top and said at least one side thereof when said cross-pieces are in said second position; and III. means for retaining said cross-pieces in said second position.

2. The enclosure of claim 1 further including a fixed cross-piece interconnecting said pair of first uprights at a location intermediate a top and bottom thereof and carrying a second plurality of first attachment means at spaced intervals therealong, and a second plurality of second attachment means disposed adjacent one end of said cover at locations thereon corresponding to the locations of the second plurality of first attachment means so that said one end of said cover may be attached to said fixed cross-piece.

3. The enclosure of claim 1 further comprising a pair of end panels attached to said end members to enclose the ends of said space.

4. The enclosure of claim 1 wherein the retaining means comprises an aperture formed through each of said top members at a location thereon proximate the interconnection with the second upright, and a lock pin engagable with each of said apertures, said apertures being located on said top members such that, when said cross-pieces are in said second position and said cover is attached to said cross-pieces, one of said plurality of cross-pieces closest the pair of second uprights is prevented from sliding motion along said top members.

5. The enclosure of claim 1 wherein the ends of each sliding cross-piece are configured to define a bore dimensioned to encompass said tubular uprights and top members for sliding motion therealong.

6. The enclosure of claim 1 further comprising a pair of opposed bottom members interconnecting said pairs of first and second uprights.

7. The enclosure of claim 1 further comprising a plurality of parallel pockets formed in said cover and extending thereacross from one side to the other at said spaced intervals and configured to receive said plurality of cross-pieces.

8. The enclosure of claim 1 wherein said cover is formed of a material selected from the group consisting of: plastic laminates, nylon, rip stop nylon, canvas, oilcloth, and combinations thereof.

9. The enclosure of claim 7 wherein each of said plurality of pockets is formed of a rectangular piece of material attached to said cover along a longitudinal centerline of said piece to define two flaps extending from said cover, the edges of said flaps provided with mating strips of hook and loop fastening material such that one of said plurality of cross-pieces may be enclosed within said flaps.

10. The enclosure of claim 1 further comprising a plurality of rings slidingly disposed along said top members and said pair of first uprights, each ring carrying a first attachment means for engagement with a corresponding second attachment means disposed on said cover to attach said cover to said frame.

11. A convertible enclosure for enclosing all but one side of a rectangular parallelepipoid space comprising:

I. a frame including:

A) a pair of opposed, parallel end members arranged to define said space therebetween and each including first and second of tubular uprights and an interconnecting tubular top member, the interconnection between said top member and each said first uprights defining a curve; and B) a plurality of sliding cross-pieces connecting said opposed end members and configured to slide along both of said first uprights and along said top members from a first position, wherein said plurality of cross-pieces are disposed adjacent each other on said first uprights, to a second position, wherein said plurality of cross-pieces are disposed along said top members at spaced intervals therealong, each of said sliding cross-pieces carrying a first attachment means proximate each end thereof;

II. a flexible, rectangular cover having two opposed sides and two opposed ends and configured to cover said space along the top and at least one side of said space, said cover including a plurality of second attachment means disposed along both sides of said cover at said spaced intervals and engagable with said first attachment means such that, when said cover is attached to said cross-pieces by engaging said first attachment means with said second attachment means, when said cross-pieces are in said first position and covered by said cover at said top and said at least one side of said space when said cross-pieces are in said second position;

III. means for retaining said cross-pieces in said second position; and

IV. a pair of end panels attached to said end members to enclose the ends of said space.

12. The enclosure of claim 11 further including a fixed cross-piece interconnecting said pair of first uprights at a location intermediate a top and bottom thereof and carrying a second plurality of first attachment means at spaced intervals therealong, and a second plurality of second attachment means disposed adjacent one end of said cover at locations thereon corresponding to the locations of the second plurality of first attachment means so that said one end of said cover may be attached to said fixed cross-piece.

13. The enclosure of claim 11 wherein the retaining means comprises an aperture formed through each of said top members at a location thereon proximate the interconnection with the second upright and a lock pin engagable with each of said apertures, said apertures being located on said top members such that, when said cross-pieces are in said second position and said cover is attached to said cross-pieces, one of said plurality of cross-pieces closest the pair of second uprights is prevented from sliding motion along said top members.

14. The enclosure of claim 11 wherein the ends of each sliding cross-piece are configured to define a bore dimensioned to encompass said tubular uprights and top members for sliding motion therealong.

15. The enclosure of claim 11 further comprising a pair of opposed bottom members interconnecting said pairs of first and second uprights.

16. The enclosure of claim 11 further comprising a plurality of parallel pockets formed in said cover and extending thereacross from one side to the other at said spaced intervals and configured to receive said plurality of cross-pieces.

17. The enclosure of claim 16 wherein each of said plurality of pockets is formed of a rectangular piece of material attached to said cover along a longitudinal centerline of said piece to define two flaps extending from said cover, the edges of said flaps provided with mating strips of hook and loop fastening material such that one of said plurality of cross-pieces may be enclosed within said flaps.

18. The enclosure of claim 11 further comprising a plurality of rings slidingly disposed along said top members and said pair of first uprights, each ring carrying a first attachment means for engagement with a corresponding second attachment means disposed on said cover to attach said cover to said frame.

* * * * *